United States Patent [19]

Smith et al.

[11] 4,456,575

[45] Jun. 26, 1984

[54] PROCESS FOR FORMING A CONTINUOUS FILAMENT YARN FROM A MELT SPINNABLE SYNTHETIC POLYMER

[75] Inventors: Francis S. Smith; Jack Gould, both of Harrogate, England

[73] Assignee: Imperial Chemical Industries Limited, London, England

[21] Appl. No.: 419,243

[22] Filed: Sep. 17, 1982

Related U.S. Application Data

[63] Continuation of Ser. No. 230,553, Feb. 2, 1981, abandoned.

[30] Foreign Application Priority Data

Feb. 18, 1980 [GB] United Kingdom ..... 8005386
Dec. 12, 1980 [GB] United Kingdom ..... 8039819

[51] Int. Cl.[3] ..... D01D 5/12
[52] U.S. Cl. ..... 264/176 F; 264/234
[58] Field of Search ..... 264/176 F, 210.8, 234

[56] References Cited

U.S. PATENT DOCUMENTS 2,289,860 7/1942 Babcock ..... 264/176 F

FOREIGN PATENT DOCUMENTS 942975 11/1963 United Kingdom ..... 264/176 F
1034401 6/1966 United Kingdom ..... 264/176 F
1069682 5/1967 United Kingdom ..... 264/176 F
1081379 8/1967 United Kingdom ..... 264/176 F
1262811 2/1972 United Kingdom ..... 264/176 F
1330847 9/1973 United Kingdom ..... 264/176 F
1478787 7/1977 United Kingdom ..... 264/176 F

*Primary Examiner*—Jay H. Woo
*Attorney, Agent, or Firm*—Herbert M. Adrian, Jr.

[57] ABSTRACT

A process for forming a continuous filament yarn from a melt-spinnable synthetic linear polymer and novel yarns of polyethylene terephthalate and yarns of polyhexamethylene adipamide produced by the process, the process comprising extruding the molten polymer through a shaped orifice to form a molten filamentary material, passing the molten filamentary material through a solidification zone, passing the solidified filamentary material through a conditioning zone provided with a gaseous atmosphere at a temperature above the glass transition temperature of the material and below its melting temperature, withdrawing the resulting filamentary yarn from the conditioning zone and winding up such yarn, characterized in that the gaseous atmosphere in the conditioning zone is compressed steam at an absolute pressure in excess of 5 psig and preferably, in the case of a yarn of polyethylene terephthalate, between 50 and 156 psig and preferably, in the case of a yarn of polyhexamethylene adipamide, between 14 and 70 psig.

6 Claims, 2 Drawing Figures

Figure 1:
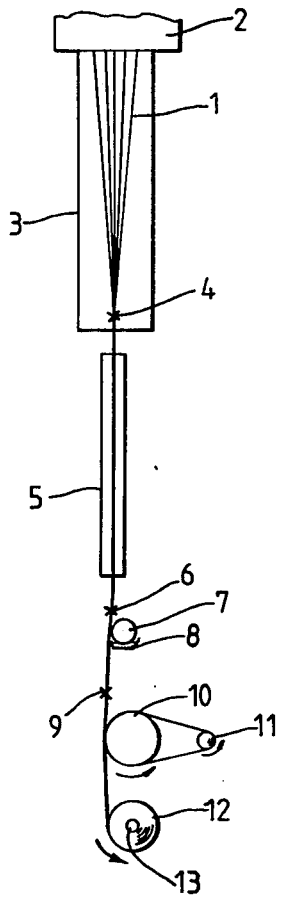

PROCESS FOR FORMING A CONTINUOUS FILAMENT YARN FROM A MELT SPINNABLE SYNTHETIC POLYMER

This is a continuation of application Ser. No. 230,553, filed Feb. 2, 1981 now abandoned.

This invention relates to a process for forming continuous filament yarns from molten melt-spinnable synthetic linear polymers, such yarns not requiring to be drawn subsequent to winding up after spinning. It also relates to novel polyester yarns which may be produced by the process. It further relates to polyamide yarns produced by the process.

Polymeric filamentary yarms have been produced under a wide variety of melt extrusion conditions.

In German Patent OLS No. 2 117 659 there is described a melt extrusion process comprising extruding a polymeric melt through a multiorifice spinneret to form a plurality of filaments, passing the filaments through a transverse current of a cooling gas in order to solidify the filaments, passing the solidified filaments through a heating zone and winding up the filaments. In one embodiment of the process, the heating zone comprises an air-filled heated shaft through which the solidified filaments are passed.

In British Patent Specification No. 1 487 843 there is described a somewhat similar process for forming a polyester filamentary material comprising extruding a melt-spinnable polyester material through a shaped orifice, passing the resulting molten filamentary material through a solidification zone consisting of a gaseous atmosphere at a temperature below the glass transition temperature of the material, passing the resulting solidified filamentary material through a conditioning zone provided with a gaseous atmosphere at a temperature above its glass transition temperature and below its melting temperature, and withdrawing the resulting crystallised filamentary material from the conditioning zone. The gaseous atmosphere used in the conditioning zone of the process described in Specification No. 1 487 843, may, amongst other gases, be static air or steam.

Also in British patent application No. 11633/76 there is described another process for producing filamentary material based on either polyamides or polyesters comprising extruding the molten polymeric material to form filaments, advancing the molten filaments through a solidification zone, advancing the solidified filaments through a tensioning zone without inducing substantial drawing thereof within the zone, advancing the solidified filaments through a treatment zone comprising a fluid atmosphere heated to a temperature above the glass transition temperature of the filaments and withdrawing the filaments from the treatment zone at a velocity of from 1000 meters/minute. The fluid is preferably air but may be nitrogen or steam.

A further process is described in British Patent Specification No. 1 478 787 in which immediately after being quenched, a spun yarn composed of polyhexamethylene adipamide (Nylon-6,6) is subjected to a steam atmosphere in an open tube preferably supplied with steam. The steam at atmospheric pressure serves to provide the yarn with a positive dry thermal shrinkage between 90° and 140° C.

We have now found that considerable advantages can be achieved by passing a melt-spun filamentary yarn through a conditioning zone comprising a steam atmosphere at pressures much higher than those used previously.

According to the invention, therefore, we provide a process for forming a continuous filament yarn from a melt-spinnable synthetic linear polymer comprising extruding the molten polymer through a shaped orifice to form a molten filamentary material, passing the molten filamentary material in the direction of its length through a solidification zone wherein the molten filamentary material is solidified, passing the solidified filamentary material in the direction of its length through a conditioning zone provided with a gaseous atmosphere at a temperature above the glass transition temperature of the material and below its melting temperature, withdrawing the resulting filamentary yarn from the conditioning zone and winding up such yarn, characterised in that the gaseous atmosphere in the conditioning zone is compressed steam at an absolute pressure in excess of 5 psig and more preferably in excess of 10 psig.

Figure 2:
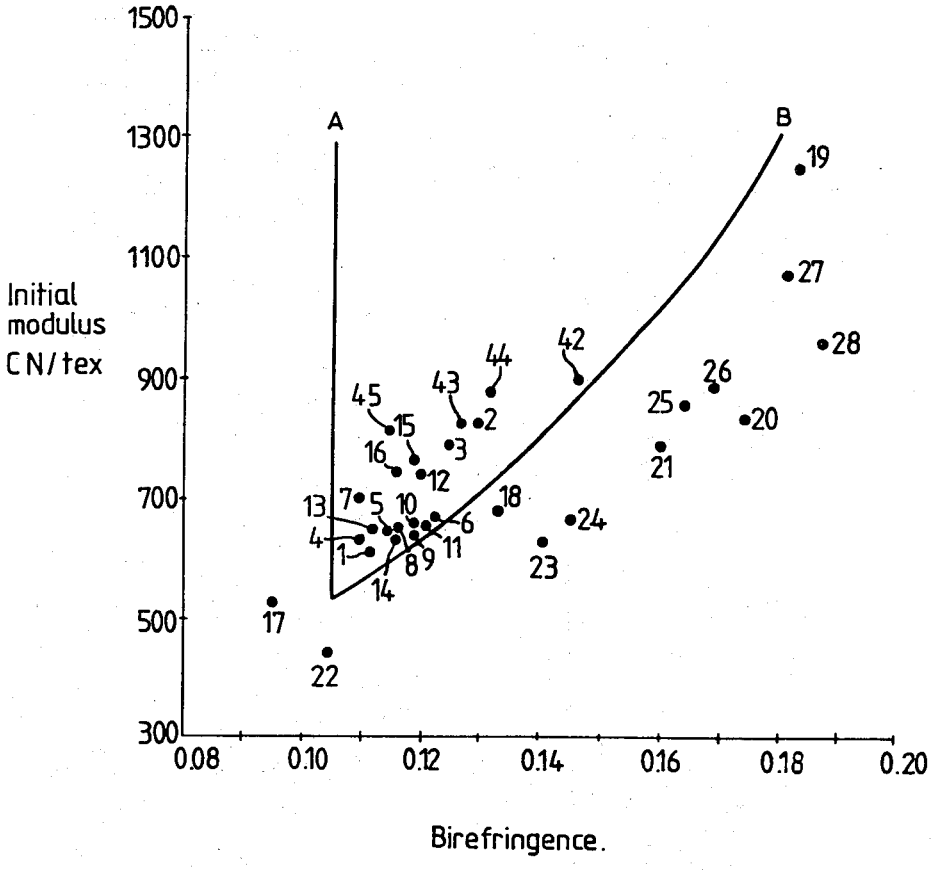

The invention will be more readily understood by reference to the drawings wherein:

FIG. 1 is a schematic showing the spinning process of the present invention and, FIG. 2 is a graph showing the initial modulus plotted against birefringence.

The term "yarn" as used herein means a monofilament yarn, a multifilament yarn or a multifilament staple tow.

The process of the invention can be used to produce filament yarns from any of the usual synthetic linear polymers which can be melt-spun into individual filaments such as polyesters, polyamides or polyolefins, in particular, for example, polyethylene terephthalate and its copolyesters, polyepsilon-caproamide, polyhexamethylene adipamide, polypropylene and the like. These polymers may be spun into very fine individual filaments which may then be combined, according to end use, into yarns or tows which may then be processed in the usual way.

The process is particularly suitable for producing filamentary fibres from melt-spinnable polyesters based on polyethylene terephthalate and containing at least 85 mol percent ethylene terephthalate and preferably at least 90 mol percent ethylene terephthalate. In a particularly preferred embodiment of the process the melt-spinnable polyester is substantially all polyethylene terephthalate. Alternatively, during preparation of the polyester, minor amounts of one or more ester-forming ingredients other than ethylene glycol or terephthalic acid or its derivatives may be copolymerised. For instance, the melt spinnable polyester may contain 85 to 100 mol percent (preferably 90 to 100 mol percent) ethylene terephthalate structural units and 0 to 15 mol percent (preferably 0 to 10 mol percent) copolymerised ester units other than ethylene terephthalate. Illustrative examples of other ester-forming ingredients which may be copolymerised with ethylene terephthalate units include glycols such as diethylene glycol, tetramethylene glycol, hexamethylene glycol, and dicarboxylic acids such as hexahydro terephthalic acid, dibenzoic acid, adipic acid, sebacic acid, acelaic acid.

The melt-spinnable polyethylene terephthalate selected for use in the process preferably exhibits an intrinsic viscosity, ie IV, of 0.45 to 1.0 dl/gm, and more preferably an IV of between 0.60 and 0.95 dl/gm. The IV of the melt spinnable polyester may be conveniently determined by the formula:

$$\lim_{C \to 0} \frac{\ln hr}{C}$$

where hr is the "relative viscosity" obtained by dividing the viscosity of a dilute solution of the polymer by the viscosity of the solvent employed (measured at the same temperature) and C is the polymer concentration in the solution expressed in grams/100 ml.

The polyethylene terephthalate additionally commonly exhibits a glass transition temperature of 75°-80° C. and a melting point of 250° to 265° C. eg about 260° C.

The extrusion orifice may be selected from those spinnerets commonly used to extrude fibres. The spinneret will be provided with a plurality of extrusion orifices—in the case of a filament yarn up to about 40 orifices will be used and in the case of a tow, several thousand orifices will be used.

For instance a standard spinneret containing a multiplicity of orifices, such as commonly used in the melt spinning of polyethylene terephthalate, each orifice having a diameter of 125-500 μm may be utilised in the process. The orifices may be circular or non-circular in cross-section.

The polyester material is supplied to the extrusion orifice at a temperature above its melting point, more preferably at a temperature of 270° to 310° C. and most preferably at a temperature of 285° to 305° C.

Subsequent to extrusion through the shaped orifice the resulting molten filamentary material is passed in the direction of its length through a solidification zone, often referred to as a "quench" zone, provided with a gaseous atmosphere at a temperature below the glass transition temperature thereof wherein the molten filamentary material is converted into a solid filamentary material. Within the solidification zone the molten material passes from the molten to a semi-solid consistency and then from a semi-solid consistency to a solid consistency. While present as a semi-solid the filamentary material undergoes substantial orientation. Preferably the gaseous atmosphere of the solidification zone is provided at a temperature of 10° to 40° C. and most preferably at ambient temperature. The chemical composition of the gaseous atmosphere is not critical provided it is not unduly reactive with the polyester material. In practice air is usually used.

The gaseous atmosphere in the solidification zone preferably impinges upon the molten filamentary material so as to provide a uniform quench so that no substantial radial non-homogeneity exists in the solidified product.

The solidification zone is preferably disposed immediately below the shaped extrusion orifice. If desired, however, a hot shroud may be positioned intermediate the shaped orifice and the solidification zone.

It is preferred that the extruded filamentary material resides in the solidification zone, while axially suspended therein, for a period of between 10 and 250 milliseconds and more preferably between 30 and 150 milliseconds. Commonly the solidification zone has a length of between 0.5 meter and 4 meters and preferably a length of between 1 and 3 meters.

The solidified filamentary material is converged into a yarn which is passed in the direction of its length through a conditioning tube containing an atmosphere of compressed steam having, preferably, an absolute pressure of between 20 and 210 psig and more preferably between 50 and 156 psig.

A suitable conditioning tube consists of a metal tube fitted with valves at each end. The valves, when open, permit the yarn to be fed through the tube. The valves, when closed, still allow free movement of the yarn. Inevitably, however, there is a continuous, but small, loss of steam from the conditioning tube.

The tube is fitted with appropriate means for facilitating steam/pressure control at the required levels.

The tube may be lagged. Preferably, however, it is provided with an insulation jacket into which is fed steam from the same source of supply as that used in the conditioning tube itself.

Preferably the tube is of circular section and has a length in the range 10 cm to 1.5 meters and an internal diameter in the range 3 mm to 40 mm.

The yarn is withdrawn from the conditioning zone at a velocity in excess of 3000 meters/min and more preferably in excess of 3500 meters/min and is finally wound-up on a suitable rotating bobbin winder, optionally after the application of a suitable spin finish to the yarn.

Under the influence of the hot pressurised steam within the conditioning zone and the tension applied to the yarn by winding it up at a high wind-up speed, crystallisation and orientation of the filaments within the yarn occurs, a process which can be compared with a drawing process commonly carried out on the yarn as a post wind-up stage in the processing of yarn. Thus in the process of the invention the filament yarn is drawn while it is in, and immediately after leaving, the conditioning zone so that there is a difference in speed and thickness of the filaments before and after the conditioning zone.

The distance of the conditioning zone from the spinneret can be selected within wide limits depending on the polymeric material. When the polymeric material is polyethylene terephthalate then we have found that an optimum distance between the outlet of the spinneret and the commencement of the conditioning zone may be selected in the range 0.5 to 40 meters.

Furthermore the length of the conditioning zone will depend on the temperature of the steam atmosphere within the conditioning zone. However, the length of the conditioning zone must in any case be such that the desired crystallisation and orientation of the filament yarn can be achieved.

Using the process of the invention for processing a polyester the following advantages are achieved.

1. Rapid and uniform heating of the filaments occurs due to very good heat transfer and because of this the filaments can be converged and treated in the conditioning zone as a yarn or tow so reducing filament to filament variability.

2. Because a considerable number of filaments are heated at the same time at a uniform temperature we ensure that there is more uniformity of properties between spinning positions in addition to the increased uniformity between filaments within a yarn gained by treating the filaments as a yarn instead of individually.

A further advantage, however, is that the process allows the production of novel fibres based on polyethylene terephthalate.

According, therefore, to a further aspect of the invention we provide a continuous filament yarn formed from a melt spinnable polyethylene terephthalate characterised in that the filaments have a birefringence ($\Delta n$)

greater than 0.105 and 5% modulus greater than 290 centi Newtons/tex and an initial modulus (IM) defined by the function:

$$IM \geqq 260 \cosh\left(\frac{\Delta n}{0.0784}\right)$$

Birefringence, as will be known to those skilled in the art, is a function of the orientation of a filamentary fibre and expressed as the difference in the refractive index of a filamentary fibre parallel to and perpendicular to its axis.

Birefringence is measured using a polarising microscope and a Berek compensator as described for example by R. C. Faust in "Physical Methods of Investigating Textiles", Edited by R. Meredith and J. W. S. Hearle and published by Textile Book Publishers Inc.

Modulus is defined as the ratio of load to extension. However, for polymers, since the load-extension curve is not a straight line the modulus must be referred to in relation to a portion of the curve. Modulus may be measured on an Instron testing machine.

Initial Modulus is defined as the maximum slope of the load-extension curve within the region 0–2% extension.

The 5% Modulus is the slope of the line joining the origon of the load-extension curve to the point on the curve corresponding to a 5% extension.

Both modulii are measures of the resistance of the filamentary material under test to extension and bending.

A long-period spacing (LPS) of less than 200 Å is a characteristic of most and probably all of the filament yarns of the invention produced from polyethylene terephthalate.

The long-period spacing is obtained from small angle x-ray scattering patterns made by known photographic procedures. X-radiation of wavelength 1.54 Å is passed through a parallel bundle of filaments mounted in a Kratky low-angle camera in a direction perpendicular to the filament axis and the diffraction pattern is recorded on photographic film mounted 29.5 cm from the filaments. Discrete meridional scattering is obtained at angles of less than about 1°. The intensity pattern is desmeared by known mathematical procedures, and from a knowledge of the geometry of the apparatus and the measured diffraction angles, the long period spacing is calculated as described, for example, in the book "X-ray Diffraction Methods in Polymer Science" by L E Alexander, published by J Wiley and Sons, New York (1969).

The process of the invention, as stated previously, is also eminently suited to the processing of filament yarn of polyhexamethylene adipamide (Nylon-6,6) and polyepsilon-caproamide (Nylon-6).

The extruded and solidified filamentary material prepared in a manner similar to that already described for polyethylene terephthalate is next passed through the conditioning zone provided by an atmosphere of compressed steam having preferably an absolute pressure of between 10 and 75 psig and more preferably between 14 and 70 psig.

The filament yarn is withdrawn and wound-up as for polyethylene terephthalate.

The invention will now be described with reference to FIG. 1 of the accompanying drawings which shows diagrammatically an apparatus for use in the preparation of filamentary fibres according to the invention.

In FIG. 1, filaments 1 are extruded from a spinneret assembly 2 into a solidification (quench) zone comprising a chimney 3 in which the filaments are quenched by air, at room temperature, flowing (not shown) from one side of the chimney to the other side of the chimney.

The filaments are solidified and converged into a yarn by a guide 4 and then pass into a conditioning zone 5.

The conditioning zone is a metal tube fitted with valves (now shown) at each end. The valves, when open, permit the yarn to be fed through the tube. The valves, when closed, still allow free movement of the yarn. Inevitably, however, there is a continuous, but small, loss of steam from the conditioning tube. Means (not shown) are provided for feeding steam from an appropriate source (not shown) into the tube at various required pressures.

The tube may be lagged. Alternatively, however, it is provided with a jacket into which pressurised steam can be fed from the same steam source as is used for the conditioning tube itself. In this way uniform temperatures may be maintained in the conditioning tube.

After leaving the conditioning zone the yarn optionally passes through a guide 6, over a finish roller 7, partially immersed in a finishing bath 8, through a guide 9, wrapped around high-speed puller rollers 10 and 11 and then is wound up as a package 12 on a bobbin 13.

The invention will now be described with reference to the following Examples:

EXAMPLES 1–16

In a process for melt spinning a filament yarn from molten polyethylene terephthalate through a spinneret at 291° C. employing an ambient air quench zone immediately below the spinneret to effect solidification of the filaments, the solidified filaments were passed through a conditioning zone. The zone consisted of a vertically disposed tube, about 0.5 meter in length and 0.5 cm in diameter, located (entry point) 2.2 meters below the exit from the spinneret.

The yarn entered and exited from the tube through suitable valves located at each end of the tube. Within the tube was an atmosphere of pressurised steam which was continuously fed into the tube from a suitable source. A continuous leakage of steam occurred through the valves.

After the application of a spin finish, the yarns produced were finally wound-up on a bobbin at velocities of 4,000 to 6,000 meters/minute.

The process conditions were varied considerably and the results obtained tabulated in Table 1.

TABLE 1

| EXAMPLE NO | REF | YARN VELOCITY (km/min) | IV (dl/g) | DECITEX | NO OF FILAMENTS | STEAM PRESSURE (PSIG) | STEAM TEMP (°C.) | BIREFRINGENCE (× $10^3$) | 5% MODULUS (cN/TEX) | INITIAL MODULUS (cN/TEX) | LPS (Å) |
|---|---|---|---|---|---|---|---|---|---|---|---|
| 1 | 4489 | 4.75 | 0.64 | 92.1 | 20 | 446 | 147 | 112 | 304 | 615 | — |
| 2 | 4493 | 4.75 | 0.64 | 92.0 | 20 | 790 | 166 | 131 | 418 | 835 | 135 |

TABLE 1-continued

| EXAMPLE NO | REF | YARN VELOCITY (km/min) | IV (dl/g) | DECITEX | NO OF FILAMENTS | STEAM PRESSURE (PSIG) | STEAM TEMP (°C.) | BIREFRINGENCE (× 10³) | 5% MODULUS (cN/TEX) | INITIAL MODULUS (cN/TEX) | LPS (Å) |
|---|---|---|---|---|---|---|---|---|---|---|---|
| 3 | 4497 | 4.75 | 0.64 | 91.7 | 20 | 962 | 177 | 125 | 419 | 791 | — |
| 4 | 4611 | 5.0 | 0.62 | 93.0 | 20 | 652 | 162 | 110 | 295 | 632 | — |
| 5 | 4620 | 5.0 | 0.62 | 49.6 | 20 | 652 | 162 | 115 | 351 | 648 | — |
| 6 | 4650 | 5.0 | 0.62 | 91.0 | 20 | 1101 | 184 | 123 | 315 | 652 | — |
| 7 | 4671 | 5.0 | 0.60 | 88.7 | 20 | 1272 | 189 | 110 | 330 | 695 | — |
| 8 | 4684 | 5.0 | 0.62 | 163.7 | 30 | 1203 | 186 | 116 | 292 | 639 | — |
| 9 | 4687 | 5.0 | 0.62 | 163.3 | 30 | 1203 | 186 | 119 | 300 | 650 | — |
| 10 | 4690 | 5.0 | 0.63 | 163.7 | 30 | 928 | 173 | 119 | 295 | 658 | — |
| 11 | 4691 | 5.0 | 0.62 | 163.2 | 30 | 928 | 173 | 120 | 293 | 649 | — |
| 12 | 4700 | 5.0 | 0.62 | 51.2 | 20 | 1203 | 186 | 121 | 368 | 745 | — |
| 13 | 4702 | 5.0 | 0.62 | 51.4 | 20 | 1203 | 186 | 113 | 297 | 643 | — |
| 14 | 4704 | 5.0 | 0.62 | 51.6 | 20 | 1410 | 195 | 116 | 342 | 651 | — |
| 15 | 4705 | 5.0 | 0.62 | 51.4 | 20 | 1410 | 195 | 119 | 381 | 767 | 55 |
| 16 | 4706 | 5.5 | 0.62 | 51.1 | 20 | 1410 | 195 | 116 | 372 | 745 | — |

EXAMPLE 17

Polyethylene terephthalate was melt spun into a yarn using the process described in Examples 1 to 16, but with a steam pressure in the conditioning tube of only 20 psig. The properties of the yarn were as follows.

| YARN VEL (km/min) | IV (dl/g) | DTEX | NO OF FILAMENTS | STEAM PRESSURE | STEAM TEMP (°C.) | BIREFRINGENCE (× 10³) | INITIAL MODULUS (cN/TEX) |
|---|---|---|---|---|---|---|---|
| 4.75 | 0.64 | 91.5 | 20 | 239 | 126 | 95 | 530 |

EXAMPLE 18

Polyethylene terephthalate was melt spun into a yarn using the process described in Examples 1 to 16 but replacing the steam conditioning tube by an open-ended tube 1 meter long and 20 mm diameter. Hot air at a temperature of 200° C. was introduced into the bottom of the tube so that it flowed up the tube at a flow rate of 90 liters/min. The yarn properties produced were as follows.

| YARN VEL (km/min) | IV (dl/g) | DTEX | NO OF FILAMENTS | BIREFRINGENCE (× 10³) | INITIAL MODULUS (cN/TEX) |
|---|---|---|---|---|---|
| 3.5 | 0.63 | 56 | 20 | 133 | 668 |

EXAMPLES 19–28

Polyethylene terephthalate was melt spun into yarns using a conventional spinning process without a conditioner tube. These yarns were then drawn on a conventional draw frame using a hot roll and hot plate. The properties of the resultant yarns are shown in Table 2.

TABLE 2

| EXAMPLE | SPUN YARN BIREFRINGENCE × 10³ | DRAW RATIO | FEED ROLL TEMP °C. | HOT PLATE TEMP °C. | DTEX FILAMENTS | INITIAL MODULUS cN/TEX | DRAW YARN BIREFRINGENCE × 10³ |
|---|---|---|---|---|---|---|---|
| 19 | 2.0 | 5.31 | 88 | 204 | 140/24 | 1250 | 183 |
| 20 | 5.2 | 4.63 | 81 | 220* | 138/36 | 840 | 174 |
| 21 | 8.1 | 3.22 | 83 | 170 | 84/15 | 799 | 160 |
| 22 | 3.5 | 2.5 | 90 | — | 85/17 | 447 | 105 |
| 23 | 3.5 | 3.0 | 90 | — | 87/17 | 531 | 140 |
| 24 | 3.5 | 3.0 | 90 | 170 | 84/17 | 569 | 145 |
| 25 | 3.5 | 3.5 | 90 | 170 | 84/17 | 861 | 164 |
| 26 | 3.5 | 3.5 | 90 | — | 85/17 | 892 | 169 |
| 27 | 3.5 | 4.0 | 90 | 170 | 86/17 | 1079 | 181 |
| 28 | 3.5 | 4.0 | 90 | — | 88/17 | 969 | 187 |

*Hot roll followed by 5.6% relax.

It should be noted that Examples 22, 23, 26 and 28 were prepared without the use of a hot plate.

A graph was produced (FIG. 2) by plotting Initial Modulus against Birefringence for all the samples prepared in accordance with Examples 1 to 28. On the graph is also shown lines A and B which together serve to define the boundary limits of the novel polyethylene terephthalate fibres of the invention ie line A corresponds to the minimum birefringence of 0.105 and line B corresponds to $$260 \cosh\left(\frac{\Delta n}{0.0784}\right)$$

It can be seen that examples 1–16 fall within the scope of the invention but that Examples 17–28 are all outside the scope of the invention.

EXAMPLES 29–41

In a process for melt spinning a filament yarn from molten nylon 6,6 polyamide through a spinneret at 288° C. employing am ambient air quench zone immediately below the spinneret to effect solidification of the filaments, the solidified filaments were passed through a conditioning tube as described in Examples 1 to 16.

After application of a spin finish, the yarns produced were finally wound up on a bobbin at velocities of 4.0–5.0 km/min.

The process conditions were varied considerably and the results obtained tabulated in Table 3. These results show that both the tenacity and the modulus are increased with increased steam pressure/temperature in the conditioning zone.

TABLE 3

| EX NO | REF | YARN VELOCITY (km/min) | DTEX | NO OF FILAMENTS | STEAM PRESS | STEAM TEMP (°C.) | TENACITY (cN/TEX) | EXTENSION (%) | MODULUS (cN/TEX) 2% | 5% | 10% |
|---|---|---|---|---|---|---|---|---|---|---|---|
| 29 | 1551 | 5.0 | 44.2 | 13 | 352 | 137 | 39.03 | 52.0 | 333 | 244 | 162 |
| 30 | 1552 | 5.0 | 44.0 | 13 | 239 | 124 | 37.87 | 45.0 | 334 | 298 | 185 |
| 31 | 1553 | 5.0 | 44.4 | 13 | 204 | 119 | 38.41 | 43.0 | 353 | 309 | 199 |
| 32 | 1556 | 5.0 | 46.5 | 13 | 101 | 100 | 37.52 | 55.0 | 327 | 232 | 156 |
| 33 | 1657 | 4.5 | 68.6 | 20 | 445 | 147 | 39.86 | 54.1 | 329 | 226 | 157 |
| 34 | 1659 | 4.5 | 68.6 | 20 | 342 | 137 | 38.58 | 53.7 | 364 | 226 | 156 |
| 35 | 1661 | 4.5 | 68.6 | 20 | 239 | 124 | 37.89 | 53.7 | 363 | 228 | 151 |
| 36 | 1665 | 4.5 | 68.7 | 20 | 171 | 114 | 37.09 | 59.7 | 357 | 217 | 143 |
| 37 | 1669 | 4.5 | 68.2 | 20 | 101 | 100 | 36.64 | 64.3 | 338 | 201 | 129 |
| 38 | 1566 | 4.0 | 40.5 | 13 | 239 | 124 | 39.20 | 45.2 | 315 | 237 | 162 |
| 39 | 1567 | 4.0 | 45.2 | 13 | 342 | 137 | 40.33 | 54.2 | 331 | 212 | 147 |
| 40 | 1569 | 4.0 | 44.8 | 13 | 171 | 114 | 43.75 | 50.7 | 350 | 263 | 171 |
| 41 | 1572 | 4.0 | 45.2 | 13 | 101 | 100 | 38.16 | 54.1 | 325 | 217 | 139 |

In the above Table 3 it should be noted that Examples 32, 37, 41 are outside the scope of the present invention.

EXAMPLES 42–45

Examples 1–16 were repeated using slightly different processing conditions. The results obtained are tabulated in Table 4.

TABLE 4

| EX NO | REF | YARN VELOCITY (Km/min) | IV (dl/g) | DTEX | NO OF FILAMENTS | STEAM PRESSURE ($KN/m^2$) | STEAM TEMP (°C.) | BIREFRINGENCE ($\times 10^3$) | 5% MODULUS (cN/TEX) | INITIAL MODULUS (cN/TEX) | LPS (Å) |
|---|---|---|---|---|---|---|---|---|---|---|---|
| 42 | 1955 | 5.0 | 0.63 | 49.5 | 20 | 790 | 166 | 146 | 460 | 892 | 140 |
| 43 | 1946 | 5.0 | 0.63 | 49.7 | 20 | 790 | 166 | 126 | 402 | 826 | 160 |
| 44 | 1950 | 5.0 | 0.63 | 48.8 | 20 | 823 | 171 | 131 | 386 | 879 | 160 |
| 45 | 1949 | 5.0 | 0.63 | 49.7 | 20 | 790 | 166 | 117 | 351 | 820 | 135 |

We claim:

1. A process for forming a continuous filament yarn from a melt-spinnable synthetic linear polymer comprising extruding the molten polymer through a shaped orifice to form a molten filamentary material, passing the molten filamentary material in the direction of its length through a solidification zone wherein the molten filamentary material is solidified, passing the solidified filamentary material in the direction of its length through a conditioning zone provided with a gaseous atmosphere at a temperature above the glass transition temperature of the material and below its melting temperture, withdrawing the resulting filamentary yarn from the conditioning zone and winding up such yarn at a velocity in excess of 3000 meters per minute, the improvement being that the gaseous atmosphere in the conditioning zone is compressed steam at an absolute pressure in excess of 5 psig.

2. A process as claimed in claim 1 the improvement being that the compressed steam is at an absolute pressure in excess of 10 psig.

3. A process for forming a continuous filament yarn of polyethylene terephthalate containing at least 85 mol percent of ethylene terephthalate as claimed in claim 1 the further improvement being that the compressed steam is at an absolute pressure of between 20 and 210 psig.

4. A process for forming a continuous filament yarn of polyethylene terephthalate containing at least 85 mol percent of ethylene terephthalate as claimed in claim 3 the further improvement being that the compressed steam is at an absolute pressure of between 446 and 1176 $kN/m^2$.

5. A process for forming a continuous filament yarn of polyhexamethylene adipamide as claimed in claim 1 the further improvement being that the compressed steam has an absolute pressure of between 10 and 75 psig.

6. A process as claimed in claim 5 the further improvement being that the steam has an absolute pressure of between 14 and 70 psig.

* * * * *